United States Patent [19]

Meyer

[11] 4,026,560

[45] May 31, 1977

[54] PUZZLE

[76] Inventor: Jim Meyer, 40 Fairview Ave., Tuckahoe, N.Y. 10707

[22] Filed: June 9, 1976

[21] Appl. No.: 694,082

[52] U.S. Cl. ..... 273/159

[51] Int. Cl.[2] ..... A63F 9/06

[58] Field of Search ..... 273/153 R, 159

[56] References Cited

UNITED STATES PATENTS

| | | | |
|---|---|---|---|
| 640,555 | 1/1900 | Fuller | 273/159 UX |
| 658,083 | 9/1900 | Favour | 273/153 R UX |
| 843,490 | 2/1907 | Pusey | 273/159 |

FOREIGN PATENTS OR APPLICATIONS

| | | | |
|---|---|---|---|
| 1,213,936 | 11/1970 | United Kingdom | 273/159 |

*Primary Examiner*—Anton O. Oechsle
*Attorney, Agent, or Firm*—Jack D. Slobod

[57] ABSTRACT

A puzzle includes a cubic polyhedron having integral posts projecting perpendicularly from the midpoint of each linear edge. A cord is wound serially about each post and back to a point of beginning with the restriction that at most two lengths of cord may lie along any face.

6 Claims, 5 Drawing Figures

PUZZLE

FIELD OF THE INVENTION

The present invention relates generally to puzzles of a type in which a cord is wound serially about a series of posts. In its particular aspects, the present invention is related to a three-dimensional puzzel in which the posts are carried projecting from linear edges of a polyhedron.

BACKGROUND OF THE INVENTION

Various puzzles have heretofore been known which involve the serial winding of a continuous filament, such as a cord, wire, string or elastic serially about a plurality of posts. Illustrative of the prior art in this regard are U.S. Pat. No. 694,038 and 843,490. The prior art of which I am aware has been restricted to the winding of the filament in a single plane because of the manner of placement of the posts.

OBJECTS OF THE INVENTION

It is an object of the present invention to provide a three-dimensional support for a plurality of posts to enable three-dimensional winding of a continuous filament about the posts.

It is a further object of the present invention to provide a challenging puzzle in which a string is wound about a polyhedron.

SUMMARY OF THE INVENTION

Briefly, the aforementioned and other objects of the present invention are satisfied by providing a polyhedron such as a cube having a plurality of linear edges defined by the intersecting planar faces thereof. Post means are provided projecting perpendicularly from a midpoint of each linear edge and a continuous filament is provided to be wound from a post means of beginning serially through each post means and back to the post means of beginning according to a variety of rule constraints.

Other objects, features and advantages of the present invention will become apparent upon perusal of the following detailed description of the preferred embodiment thereof when taken in conjunction with the appended drawing wherein.

DETAILED DESCRIPTION

Figure 1:
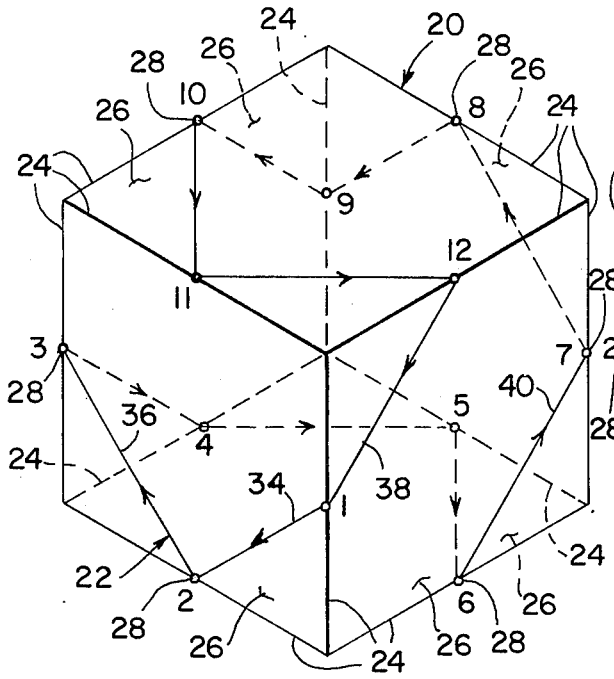
FIGS. 1 through 3 are similar three-dimensional pictorial presentations of the puzzle of the present invention showing its solution according to three different rule constraints.

Referring to FIGS. 1 through 5 of the drawing, according to the principles of the present invention a polyhedron 20 is utilized in conjunction with a continuous filament 22 such as string, cord, wire or elastic which is wound about the polyhedron according to several possible rule constraints. As illustrated, the polyhedron 20 is preferably a cube. As is well known in solid geometry, the term "cube" is encompassed by the broader terms, "hexahedron," "parallelelopiped" and "rectangular solid."

Figure 4:
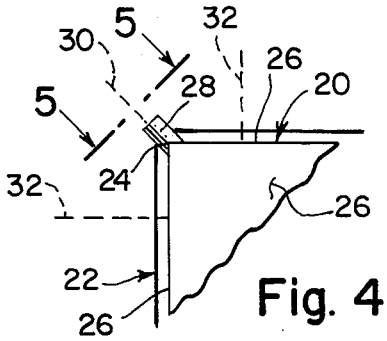
FIG. 4 is an enlarged partial elevation view along an edge of the puzzle.
Figure 5:
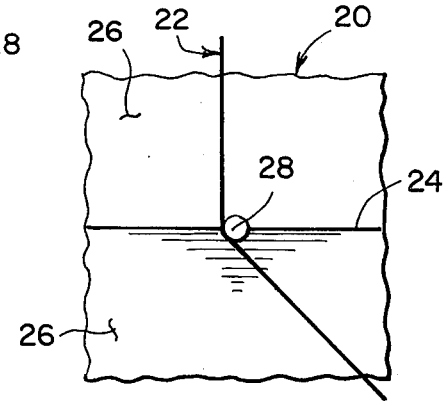
FIG. 5 is a rotated view of the puzzle edge along the arrows 5—5 in FIG. 4.

Cube 10 has twelve linear edges 24 defined by the intersection of the six planar faces 26 of the cube. At the midpoint of each of the linear edges 24 a cylindrical integral post 28 projects outward perpendicular to each edge 24. As best shown in FIGS. 4 and 5, the axis 30 of cylindrical post 28 makes a 45° angle with the normals 32 to the intersecting planar faces 26 defining linear edge 24. It should be appreciated that orientation of each post enables the filament 22 to be tensioned about a side of a particular post 28 and then trained to any other post 28 associated with the faces 26 defining the edge 24 on which is post is located.

As previously indicated various rule constraints are possible. The solutions to three different illustrative rule constraints are illustrated respectively in FIGS. 1 through 3. In these Figures, the numerals 1 through 12 are associated with the twelve posts 28 to indicate the order in which the filament 22 is serially tensioned alongside the posts. Further, in each Figure, the filament is started at a post of beginning, which is associated with the numeral 1, then consecutively to the posts associated with the numerals 2–12, and then back to the post of beginning.

The general rule applied in solving the puzzle is that the filament 22 must be threaded to touch each post only once, except the post of beginning and there may be at most two lines of filament 22 such as 34 and 36 or 38 and 40 in FIG. 1 along each face 26.

In FIG. 1, the puzzle is shown solved under a rule constraint that each line of filament, such as 34–40 must be at an angle with respect to the linear edges 24 which shall be termed "diagonal movements."

Figure 2:
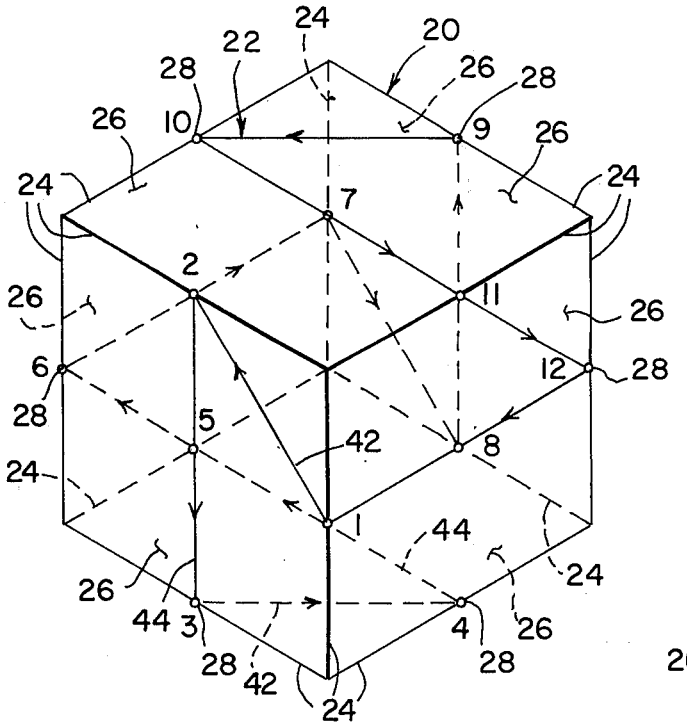

In FIG. 2, the puzzle is shown solved under a rule constraint in which diagonal movements such as 42 alternate with parallel movements such as 44 where a line of filament is directed parallel to at least one edge 24.

Figure 3:
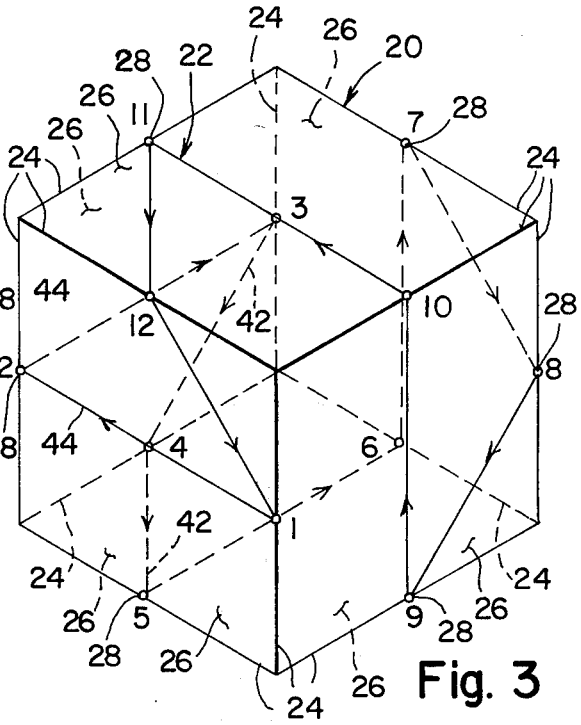

In FIG. 3, the puzzle is solved under a rule constraint in which pairs of parallel movements 44 must alternate with pairs of diagonal movements 42.

Having described the preferred embodiment of the present invention it should be understood that numerous modifications, additions and omissions in the details thereof are possible within the intended spirit and scope of the invention claimed herein.

What is claimed is:

1. A puzzle comprising: a polyhedron having a plurality of linear edges; post means projecting generally perpendicularly from all linear edges; and a filament for serial engagement about each post means.

2. The puzzle of claim 1 wherein said post means projects from a midpoint of each linear edge.

3. The puzzle of claim 2 wherein said polyhedron is a hexahedron.

4. The puzzle of claim 2 wherein said polyhedron is a parallelopiped.

5. The puzzle of claim 2 wherein said polyhedron is a retangular solid.

6. The puzzle of claim 2 wherein said polyhedron is a cube.

* * * * *